US007572972B2

(12) United States Patent
Gustafsson

(10) Patent No.: US 7,572,972 B2
(45) Date of Patent: Aug. 11, 2009

(54) SYSTEM AND METHOD FOR SIMULATION OF ACOUSTIC FEEDBACK

(75) Inventor: Fredrik Gustafsson, Linköping (SE)

(73) Assignee: Softube AB, Linkoping (SE)

( * ) Notice: Subject to any disclaimer, the term of this patent is extended or adjusted under 35 U.S.C. 154(b) by 0 days.

(21) Appl. No.: 11/667,360

(22) PCT Filed: Nov. 16, 2005

(86) PCT No.: PCT/SE2005/001722

§ 371 (c)(1),
(2), (4) Date: Nov. 20, 2007

(87) PCT Pub. No.: WO2006/054943

PCT Pub. Date: May 26, 2006

(65) Prior Publication Data

US 2008/0091393 A1 Apr. 17, 2008

(30) Foreign Application Priority Data

Nov. 17, 2004 (SE) ..... 0402813

(51) Int. Cl.
*G10H 1/02* (2006.01)
*G10H 6/00* (2006.01)

(52) U.S. Cl. ..... 84/737; 84/662

(58) Field of Classification Search ..... 84/622, 84/626, 659, 662, 736, 737
See application file for complete search history.

(56) References Cited

U.S. PATENT DOCUMENTS 485,244 A 11/1892 Vinton
4,697,491 A 10/1987 Maloney
4,941,388 A 7/1990 Hoover et al.
5,180,877 A * 1/1993 Kunimoto ..... 84/624
5,233,123 A 8/1993 Rose et al.
5,352,849 A * 10/1994 Kobayashi ..... 84/659
5,449,858 A 9/1995 Menning et al.
5,587,548 A * 12/1996 Smith, III ..... 84/659
6,681,661 B2 1/2004 Lalonde
7,030,311 B2 * 4/2006 Brinkman et al. ..... 84/625
7,081,580 B2 * 7/2006 Brinkman et al. ..... 84/609

FOREIGN PATENT DOCUMENTS

DE 41 01 690 A1 7/1992
DE 101 29 937 A1 1/2003

* cited by examiner

*Primary Examiner*—Jeffrey Donels
(74) *Attorney, Agent, or Firm*—Harness, Dickey & Pierce, P.L.C.

(57) ABSTRACT

The invention describes an apparatus for software or hardware emulation of acoustic feedback effects. The invention comprises an analog to digital interface (200) for the input, whose output is summed (202) with a feedback of this digital signal passing through an amplifier model (204), a room acoustics model (206) and a string model (210). The summed signal (202) is converted from digital to analog (205) and can then be connected to a standard amplifier. The room acoustic model comprises a volume control (208) where the degree of feedback is controlled, while the string model contains a model (212) of which harmonics to feed back, and finally an algorithm (214) that decides which fundamental frequencies that the incoming digital signal contains.

7 Claims, 3 Drawing Sheets

SYSTEM AND METHOD FOR SIMULATION OF ACOUSTIC FEEDBACK

FIELD OF THE INVENTION

The present innovation relates in general to a system for simulation of acoustic feedback and more specifically to the feedback from an amplifier and speaker to string instruments such as guitars.

BACKGROUND

Jimi Hendrix is probably the one who has meant the most for spreading appreciation of screaming guitar amplifiers, which is nowadays an effect used by all guitarists, from amateurs to professionals. The feedback effect is physically achieved when the sound from the speakers stimulates the guitar string through the room's acoustic response, which in turn affects the speaker and so forth. FIG. 1 illustrates this feedback. Consequently, a rather high volume and short distance between guitar and speaker is needed for that to take place. This so called feedback can only be stopped by reducing the amplification to the speaker, or increasing the distance between speaker and guitar.

A practical problem for guitarists is that it is complicated to rehearse feedback effects, since high volume is necessary. For this reason, headphones, for example, can not be used. The room acoustics also affect the effect, so that, in principle, the guitarist must practice the feedback effects on the stage or in the studio where the effect is to be presented. It would therefore be of great practical interest to enable simulation of such effects and to be able to experiment in any environment using a low volume.

Acoustic feedback is an example of a feedback system with positive feedback, which makes the closed loop system unstable. The theory of feedback systems is described in all textbooks in the field of control theory, for example the textbook T. Glad and L. Ljung, *Reglerteknik, grundldggande teori* (Studentlitteratur 1989). There are currently various different control loops in use, ranging from track control and revolution control in CD players, steering servos and ABS systems in cars, to the hundreds of loops used by all process industries to control flows, temperatures, concentrations, etc. In all cases described in the literature, feedback is used to stabilize the system to be controlled. The present application to destabilize the acoustic system may therefore be seen as rather unique, for which no complete theory exists.

In order to simulate the whole physical chain in FIG. 1, a model of the amplifier, speaker, room acoustics and string dynamics is needed. How different parts in this chain can be modeled is described in textbooks concerned with modeling and system identification, for example L. Ljung and T. Glad, *Modeling of dynamic systems,* L. Ljung, *System identification, Theory for the user* (Prentice Hall, Englewood Cliffs, N.J., second edition, 1999), T. Söderström and P. Stoica, *System identification* (Prentice Hall, New York, 1989).

If this is done according to the text books, one does indeed get an unstable system, but one which does not sound anything like the true feedback effect. Common linear feedback system's theory, T. Glad and L. Ljung, *Reglerteknik, grundldggande teori* (Studentlitteratur 1989), states that the signal amplitude very quickly approaches infinity, which lacks physical meaning. Accordingly, there is a need for non-linear models and more advanced linear theory such as T. Glad and L. Ljung, *Reglerteori, flervariabla och olinjdra metoder* (Studentlitteratur 1997) or D. Atherton *Nonlinear Control Engineering.*

Earlier patents within this field all modify the guitar in one way or the other:

- U.S. Pat. No. 6,681,661 dynamically modifies the opening to the string instrument's cavity.
- U.S. Pat. No. 5,449,858 includes a coil device which is attached to the hand of the player, affecting the sound and feedback.
- U.S. Pat. No. 5,233,123, U.S. Pat. No. 4,941,388, U.S. Pat. No. 4,852,44, DE4101690 all give examples of so called sustainers, which prolong the tones with electromagnetic transmitters (so called transducers) that directly affect the strings.
- U.S. Pat. No. 4,697,491 gives an example of an electrically feedbacked guitar equipped with an electromagnetic transmitter on the neck.

SUMMARY OF THE INVENTION

The invention aims at simulating the feedback without modifying the string instrument and without using extra sensors or actuators that affect or monitor the string instrument. The physical feedback loop in FIG. 1 is simulated with a structure according to FIG. 2. An apparatus that is based on this simulation is intended to be connected between the output of the guitar's microphone and the pre-amplifier, for instance in a pedal product.

First of all, a non-linear amplifier model (204) must be used in order to get self oscillations in the computed signal. The theory of describing functions, D. Atherton *Nonlinear Control Engineering,* implies that a static non-linearity in a feedback system where all other parts are linear may cause a stable oscillation. This is the effect desired in this application. A linear model (206) of the room acoustics can be used, where a volume control (208) simulates the distance between guitar and amplifier. The most central part in the feedback loop is the string dynamics. This is preferably implemented as a band-pass filter (210) which preserves out one or more harmonics (212) of the string's fundamental frequency. To get knowledge of the string's fundamental frequency, an algorithm (214) to estimate it is needed. Thus, the string dynamics is feeding back (202) a number of harmonics to the incoming guitar microphone signal, which are in phase with the signal itself.

BRIEF DESCRIPTION OF THE DRAWINGS

The present invention will be further explained by means of exemplifying embodiments in conjunction with the accompanying drawings, in which.

DETAILED DESCRIPTION OF THE INVENTION

General Setting

The invention comprises a method and a realization of that method, which may be realized in hardware, software or a combination thereof. The most feasible realization of the invention is likely to be in the shape of a computer program product, preferably comprising a data carrier provided with program code or other means devised to control or direct a data processing apparatus to perform the method steps and functions in accordance with the description. A data processing apparatus running the invented method typically includes a central processing unit (CPU), data storage means and an I/O-interface for signals or parameter values. The invention may also be realized as specifically designed hardware and software in an apparatus or a system comprising mechanisms and functional stages or other means carrying out the method steps and functions in accordance with the description.

Amplifier Model

Figure 1:
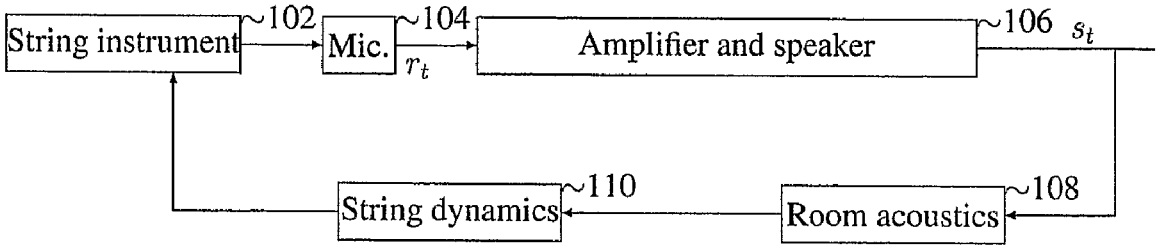
FIG. 1 shows a block diagram for the real sound flow during feedback. The string instrument (102) produces a sound that is caught by a microphone (104) whose signal is sent to an externally connected amplifier and speaker (106). The sound waves are modified on their way back to the string instrument by the room acoustics (108) and the string's dynamical response to sound waves (110).
Figure 2:
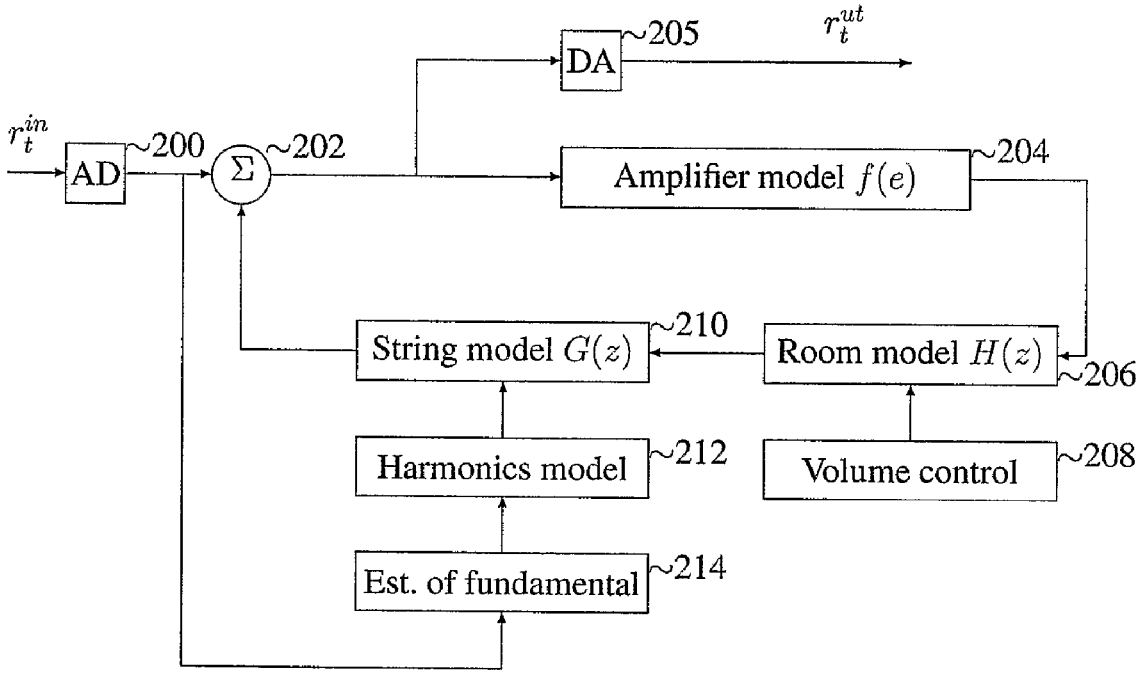
FIG. 2 shows a block diagram of simulated sound flow during feedback. H is the acoustic feedback path, and G the dynamics of the string and microphone.

In order to describe the entire loop in FIG. 2, the description of the signal e starts after the summation point (202). The central property of the amplifier model is that it is non-linear. One embodiment of the invention may use $$f(e)=\arctan(e). \tag{1}$$

More advanced models that can accurately describe the dynamics in tube amplifiers can be used, for instance the model that is described in F. Gustafsson, P. Connman, O. Vberg N. Odelholm and M. Enqvist. Softube AB. *A system and method for simulation of non-linear audio equipment,* Patent application nr SE-0301790-2, U.S. Ser. No. 10/872,012, 2003 Jun. 26.

Model of Room Acoustics

The simplest possible model of room acoustics is a pure time delay and attenuation, that with the z transform can be expressed as $$H(z)=\mathrm{a}\, e^{-zT}, \tag{2}$$

where a denotes the attenuation and T the time delay. It is suitable to let the user affect the attenuation with a volume control (208). More advanced acoustic models can be constructed utilizing real measurements from a stage, studio or other places with recognized good dynamics, by using system identification of H(z), see L. Ljung, *System identification, Theory for the user* (Prentice Hall, Englewood Cliffs, N.J., second edition, 1999) and T. Söderström and P. Stoica, *System identification* (Prentice Hall, New York, 1989).

String Model

The string dynamics is perhaps the most critical part of the feedback loop. A string under tension has a number of resonance mode, that correspond to a fundamental frequency and its harmonics. Since the physical string is to initiate the simulated self oscillation, the digital sampled signal in (200) can be used to estimate the fundamental frequency and harmonics, which will be described in the section on frequency estimation below. Suppose that we know which string that has been plucked, and thus the fundamental frequency and harmonics. The theory for describing functions mentioned above only says that the signal $r_t^{\mu t}$ that is transmitted will be periodic, and the analysis shows which sinusoid frequency will dominate the signal sent to the amplifier. For this reason, it is more or less unpredictable which harmonic will survive. For that reason, one embodiment of the invention contains a general band-pass filter G(z) that only lets one or a subset of the harmonics (including the fundamental) pass. The band-pass filter G(z) (210) can be realized in many different ways, see F. Gustafsson, L. Ljung, and M. Millnert, *Signalbehandling* (Studentlitteratur, 2000). The invention contains a database of which harmonics will pass the band-pass filter for different fundamental frequencies. The algorithm for determining the fundamental frequency is described in the next section.

Frequency Estimation

The most common algorithm to estimate frequencies is the discrete Fourier transform (DFT) F. Gustafsson, L. Ljung, and M. Millnert, *Signalbehandling* (Studentlitteratur, 2000). From the DFT, one can compute how large a part of the signal energy from the physical string that originates from a particular frequency. To detect a pluck on the string and its fundamental frequency, the energy from a certain fundamental frequency and the energies from all of its multiples can be added. This gives the energy for a periodic signal with this fundamental frequency.

The frequency estimation is to be made adaptively, which can be done with one of the following principles:

1. A recursive implementation of the DFT.
2. A batch-wise implementation of the DFT, where the DFT is computed for possibly over-lapping segments of the signal (BUFFER in (306)).
3. An adaptive model-based algorithm that for instance estimates time-varying parameters in an auto-regressive model with the LMS or RLS algorithm, see F. Gustafsson, L. Ljung, and M. Millnert, *Signalbehandling* (Studentlitteratur, 2000). These parameters can then be translated to a frequency.

In practice, the frequency estimation is preferably done in two steps. First, a rough estimate is done that physically corresponds to a played tone, and secondly, a finer estimate that tracks the vibratos and minor time-variations of the tone. Detection and rough estimation is done on larger batches or with a slower adaptive filter, while the fine estimate is done based on shorter batches or with a faster adaptive filter in order to better track fast but small variations in frequency.

Implementation

Figure 3:
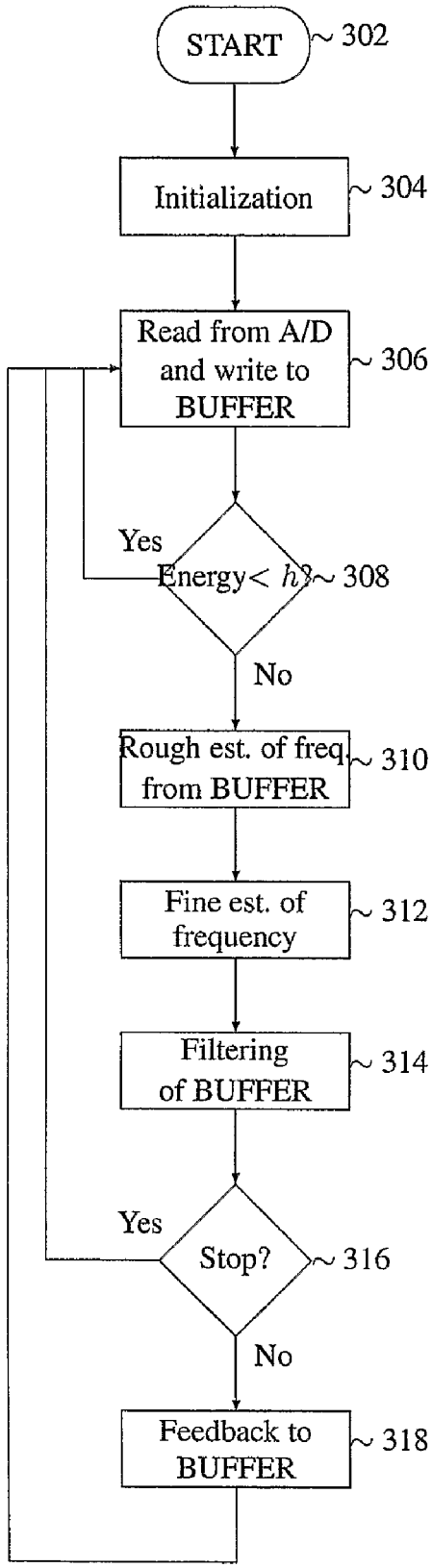
FIG. 3 shows a flow chart with one implementation of the simulation algorithm.

FIG. 3 shows a flow chart for one embodiment of the invention. When the program is initiated (304), a recursive loop with the following steps is started:

1. AD conversion and buffering (306), where a batch of digital signal samples from the string instrument is stored.
2. Energy control (308). The feedback is initiated only if the signal energy from the string instrument is large.
3. Detection and rough estimation (310) of fundamentals in the microphone signal (310).
4. Fine estimation (312) of frequency with a faster adaptive filter or smaller batches that gives a frequency estimate with small variations around the fundamental.
5. Filtering (314) of the digital signal according to the operations described above, containing amplifier model, room acoustic model and a band-pass filter.
6. A criterion (316) for whether the feedback simulation is to be active.
7. A feedback mechanism (318) that adds the computed filtered signal to the BUFFER.

The invention claimed is:

1. An apparatus for emulation of acoustic feedback in string instruments, comprising:

an input interface configured to receive a sound signal as an input and produce a first signal as an output, an amplifier and speaker emulator configured to receive said first signal as an input and produce a second signal as an output, a room acoustics emulator configured to receive said second signal as an input and produce a third signal as an output, a string dynamics emulator configured to receive said third signal as an input and produce a fourth signal as an output, a feedback configured to add said fourth signal to said first signal to produce a sum, and an output interface configured to output said sum of said fourth signal and said first signal as an output audio signal.

2. The apparatus as recited in claim 1, wherein the string dynamics emulator includes a band-pass filter controlled by a frequency content of said first signal.

3. The apparatus as recited in claim 2, further comprising an adaptive algorithm for computing fundamental frequencies and harmonics in the frequency content of said first signal.

4. A method for emulating acoustic feedback in string instruments, comprising:

receiving a sound signal as an input and producing a first signal as an output;

processing said first signal by emulating an amplifier and speaker to produce a second signal;

processing said second signal by emulating room acoustics to produce a third signal;

processing said third signal by emulating string dynamics to produce a fourth signal;

adding said fourth signal to said first signal and to produce a sum; and outputting said sum as an output audio signal.

5. A computer program product for emulating acoustic feedback in string instruments, comprising:

a computer-readable medium encoded with a program code adapted to direct a data processing system to perform the method of claim 4.

6. An apparatus for emulation of acoustic feedback in string instruments, comprising:

an input interface for receiving a sound signal and producing an input signal;

a looped signal path having an amplifier and speaker emulator, a room acoustics emulator, and a string dynamics emulator;

an adder for adding the Input signal to the looped signal path to produce a sum; and an output interface for outputting a signal from the looped signal path as an output audio signal.

7. A method for emulating acoustic feedback in string instruments, comprising:

receiving a sound signal and producing a first signal;

processing said first signal by emulating an amplifier and speaker, room acoustics, and string dynamics to produce a second signal;

adding said second signal to said first signal to produce a sum while forming a looped signal path; and outputting a signal from the looped signal path as an output audio signal.

* * * * *